United States Patent [19]

Frantz et al.

[11] 4,153,326

[45] May 8, 1979

[54] HERMAPHRODITIC WIRING SYSTEM

[75] Inventors: Robert H. Frantz, Newville; John A. Zimmerman, Jr., Hershey, both of Pa.

[73] Assignee: AMP Incorporated, Harrisburg, Pa.

[21] Appl. No.: 887,707

[22] Filed: Mar. 17, 1978

Related U.S. Application Data

[63] Continuation-in-part of Ser. No. 647,236, Jan. 7, 1976, abandoned, which is a continuation-in-part of Ser. No. 526,350, Nov. 22, 1974, abandoned.

[51] Int. Cl.[2] ..... H01R 13/38

[52] U.S. Cl. ..... 339/99 R; 339/49 R; 339/107

[58] Field of Search ..... 339/47–49, 339/91 R, 97 R, 97 P, 99 R, 103, 107, 186, 196

[56] References Cited

U.S. PATENT DOCUMENTS

| | | | |
|---|---|---|---|
| 3,337,836 | 8/1967 | Churla, Jr. | 339/49 B |
| 3,794,957 | 2/1974 | Winkler | 339/49 R |
| 3,829,819 | 8/1974 | Eckart | 339/103 R |
| 3,874,762 | 4/1975 | Shott et al. | 339/99 R |
| 3,935,637 | 2/1976 | Bunnell | 339/99 R |

FOREIGN PATENT DOCUMENTS

| | | | |
|---|---|---|---|
| 1007316 | 3/1977 | Canada | 339/97 P |

*Primary Examiner*—Joseph H. McGlynn
*Attorney, Agent, or Firm*—Russell J. Egan

[57] ABSTRACT

A connector system is disclosed for interconnecting prewired, prefabricated modules, such as panels or housing units, with the connector system providing positive wiring and locked electrical interconnection. The subject connector system includes both hermaphroditic housings and terminals with the housings providing interlocking between mating connector members and the terminals providing ease of assembly. There are several embodiments of the connector, a first is a splice to be used for intermating cables running between modular units, a second is a panel mounting used for interconnecting a modular unit with a power distribution panel or the like, and a third is a T-connection to be used for making a line tap. The terminals include an insulation displacing slot for engagement with a conductor and the cover member of the connector is profiled to drive the conductors into the respective slotted beam portions of the associated terminals. The housings and terminals are also profiled for engaging the conductors in only one way so as to obviate miswiring of the connectors.

6 Claims, 6 Drawing Figures

HERMAPHRODITIC WIRING SYSTEM

CROSS REFERENCE TO RELATED APPLICATION

The present application is a continuation-in-part of application Ser. No. 647,236 filed Jan. 7, 1976, now abandoned, which in turn is a continuation-in-part of application Ser. No. 526,350 filed Nov. 22, 1974, and now abandoned.

BACKGROUND OF THE INVENTION

1. The Field Of The Invention

The present invention relates to a hermaphroditic electrical connector, including both hermaphroditic terminals and housings, and in particular to a connector system suitable for interconnecting prewired, prefabricated modular units requiring assurance of correct wiring, positive locking interconnect, and constantly shielded conductor members.

2. The Prior Art

The use of prefabricated, prewired modular units has been constantly growing in recent years, particularly in the building industry. Such units are not only found in the mobile home field where two or more units are joined together, but in the field of static housing where prefabricated units are built at a factory and permanently assembled at a building site. Each of these units is designed as a self contained unit and includes all of the necessary electrical and plumbing fixtures which simply need to be interconnected to power sources at the building site.

The electrical interconnections for such prewired, prefabricated modular units have particular problems in that they must satisfy three basic requirements. The first requirement is the terminals and conductors must at all times be concealed so as to prevent accidental engagement with conductive surfaces, which could short the system causing the subsequent substantial danger of electrical fires. Secondly, the connector must be so configured as to present a substantial impossibility of miswiring occurring. Finally, the connectors must be capable of effecting a locking engagement which will resist disassembly, even when high pulling forces are applied to the connector, while providing sufficient strain relief to prevent separation of the cable from the connector.

There are many well known electrical connectors which will meet some of the requirements outlined above, however, there is not presently available a connector system which will entirely meet current needs. For example, U.S. Pat. Nos. 2,386,177; 2,838,739; 3,373,397; 3,654,586 and 3,732,525 all show hermaphroditic type electrical connectors which do not satisfy the above-mentioned requirements in that they either do not provide strain relief and locking or the strain relief and locking mechanisms are complex and expensive to manufacture. However, all of the connectors described in these patents do provide adequate protection for the terminals.

U.S. Pat. Nos. 2,891,103 and 3,337,836 both show a type of connector which can be used to connect cable to a panel, such as a power distribution box. The latter of these patents concerns a connector which is also hermaphroditic in nature. However, neither of these connectors includes locking means which would keep the connector members mated when a strain is placed on the associated cable. Also, neither provides positive wiring to prevent miswiring nor the convenience of insulation piercing assembly.

There are numerous devices in the prior art which provide positive latching of mated connector members, for example those described in U.S. Pat. Nos. 3,605,068 and 3,688,243. The first of these patents represents the type of locking which would require the use of a separate or special tool to effect unlocking. The second patent represents the type of lock which can be readily unlocked without the use of special tools. This type of locking mechanism has the disadvantage that it can be accidentally and unintentionally unlocked.

Hermaphroditic terminals per se are disclosed by U.S. Pat. Nos. 2,434,226; 2,460,231 and 3,202,954. This type of terminal is particularly desirable for use in a hermaphroditic connector since it eases the assembly thereof.

SUMMARY OF THE INVENTION

The present invention concerns a wiring system for interconnecting prefabricated and prewired modular units and includes a hermaphroditic connector providing positive locked intermating with like connectors and constant shielded protection of the terminals carried therein. Each connector includes a housing of insulating material with at least one terminal receiving passage extending therethrough from a conductor face to a mating face. First and second integral shroud forming wall portions extend from the mating face of the connector housing and are arranged to substantially enclose terminals extending from the mating face. Intermating locking means are formed on both of the wall portions. In one embodiment of the connector, the conductor end of the connector housing is provided with cable strain relief means, in another embodiment this same end includes means for mounting the connector housing on a panel, box or the like, in yet another embodiment this same end includes means for effecting a line tap. For each of these embodiments a cover for this same end provides wire guide members for inserting wires of the cable into an insulation displacing, slotted beam portion of the respective terminals with closure of the cover. The conductor end is also profiled to assure correct wiring of the connector.

It is therefore an object of the present invention to produce a hermaphroditic connector which includes both a hermaphroditic housing and hermaphroditic terminals and which will provide constant protection of the terminals from shorting and will provide positive interlocking with like connectors.

It is also an object of the present invention to produce a hermaphroditic connector which can be correctly and positively mated by unskilled labor.

It is another object of the present invention to produce a hermaphroditic connector which is profiled in such a manner as to make it substantially impossible to incorrectly attach to the associated cables, even when using unskilled labor.

It is a further object of the present invention to provide an improved system for electrically interconnecting prewired, prefabricated module units in such manner as to provide positive and correct locked mating of connectors.

It is still another object of the present invention to teach a wiring connection system which can be used to electrically interconnect prewired, prefabricated modular units both with like units and with power distribution panels.

It is yet another object of the present invention to provide a hermaphroditic connector with terminals having a slotted beam portion and an associated housing having wire guide members adapted to force wires into the slotted beam portions of the related terminals to make connection therewith.

It is a further object of the present invention to produce an electrical connector capable of forming a line tap.

It is a further object of the present invention to provide a wiring system in which the connectors, when mated, will withstand substantial pulling forces without becoming separated.

It is a still further object of the present invention to produce an improved hermaphroditic connector assembly which can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 4 is an exploded perspective view of a first alternate embodiment of the subject connector adapted for mounting in a power distribution panel or the like;

DETAILED DESCRIPTION OF THE PREFERRED EMBODIMENTS

Figure 1:
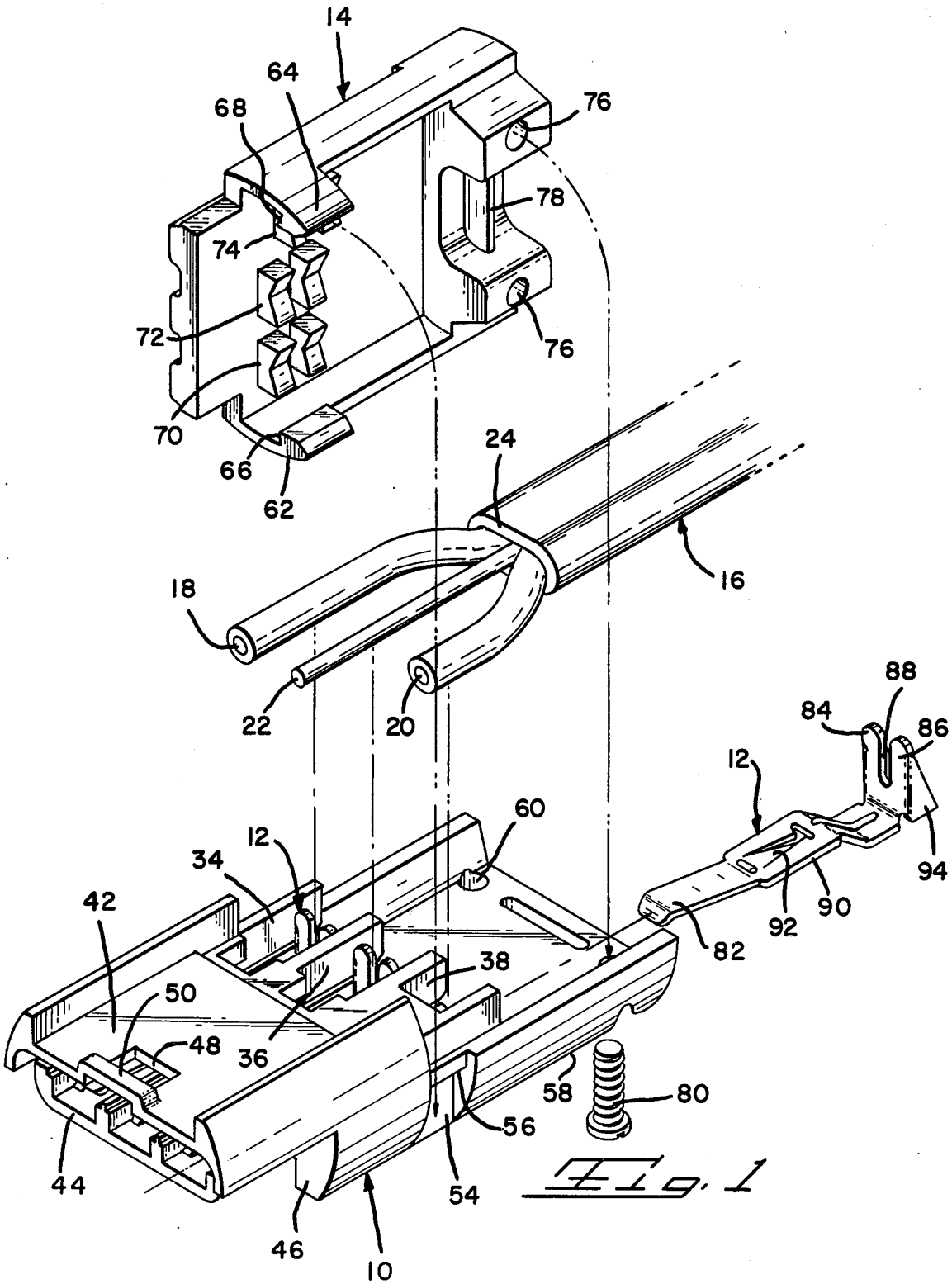
FIG. 1 is an exploded perspective view of one half of a hermaphroditic connector according to the present invention.
Figure 2:
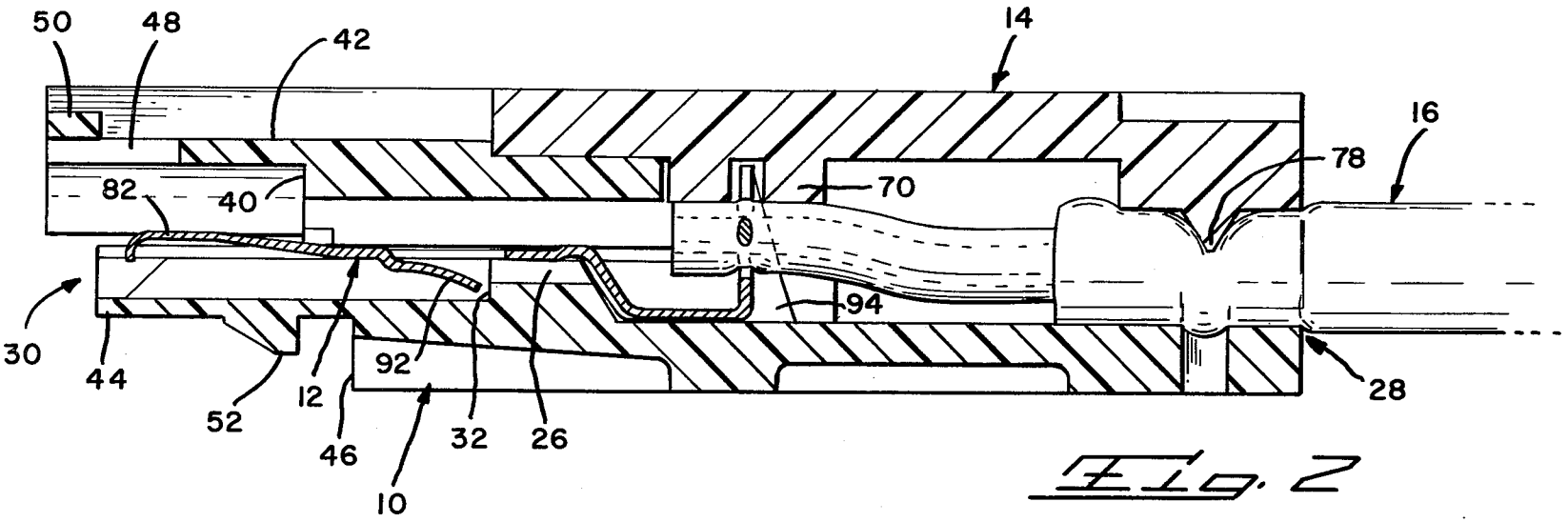
FIG. 2 is a longitudinal vertical section through the connector half of FIG. 1.

A preferred embodiment of a hermaphroditic connector used in the subject system is illustrated in FIG. 1. The connector includes a hermaphroditic housing member 10, a plurality of terminals 12 mounted in the housing, and a cover 14 closing the housing. This preferred embodiment will be described with reference to terminating a conventional cable 16 having a pair of insulated conductors 18, 20 and a ground conductor 22 within an insulating jacket 24.

The housing member 10 has a plurality of profiled terminal receiving passages 26 extending therethrough from a conductor end 28 to a mating end 30. Each passage includes a transverse step or shoulder 32 intermediate the ends thereof and an upwardly directed access opening at the rear end. It should be noted opening 38 is smaller than the other openings. The reason for this will be explained below. The mating end 30 includes a mating face 40, a first or outer hood forming wall portion 42 and a second or inner hood forming wall portion 44, both of which extend integrally from the body 10 in a spaced parallel relationship to form a hooded shroud substantially enclosing the mating face 40. The first wall portion 42 has an interior profile and dimensions which approximate the exterior profile and dimensions of the second wall portion 44. The second hood portion 44 is inwardly offset on the mating face forming an external step 46 where it joins the housing member 10. Thus, when like connector members are mated, the second hood portion slides inside the first hood portion and is in substantial engagement along the length thereof. The first wall portion 42 is further provided with an aperture 48 spaced from the free edge thereof and a latching bar 50 across the free edge of the wall portion 42 in front of the aperture. A locking lug 52 is formed integrally on the exterior of the second wall portion 44 and is aligned for mating with the aperture 48 on the opposite wall portion. Latching channels 54 are formed on opposite sides of housing 10 in substantial alignment with access openings 34, 36, 38. Each channel has a transverse shoulder 56 extending thereacross.

The rear portion or conductor end 28 of the preferred embodiment of the connector provides for engagement of the cable conductors with the terminals and, in this instance, strain relief for the cable 16. The strain relief is provided by an integral channel-shaped extension 58 with at least one bore 60 formed near the free end of the extension 58. The cover 14 is profiled to mate with the extension 58 and includes a pair of latching legs 62, 64 depending from the forward end, an inwardly directed shoulder 66, 68, respectively, on the free ends of said legs, a plurality of conductor guiding members 70, 72, 74, bores 76 near the rear end aligned with bores 60 and a transverse bar 78. The cover is held in place by latching engagement between shoulders 66, 68 of legs 62, 64 with shoulders 56 in channels 54 and by screws 80. Mounting screws 80 pass through bores 60 and engage in bores 76 to secure cover 14 in place. These screws can be self tapping screws or conventional screws with bores 76 being threaded.

The terminals 12 each include a front flat mating blade portion 82, a slotted plate rear portion including a pair of upstanding legs 84, 86 defining an insulation piercing slot 88 therebetween, and an intermediate portion 90 having a locking lance 92. The legs 84, 86 can be provided with flanges 94 which serve to strengthen the legs to prevent collapse during termination. The intermediate portion 90 can also be profiled to engage in the respective passages 26 so as to prevent undesired movement.

This embodiment would be used to terminate a cable in the following manner. The end of the cable would first be prepared as shown in FIG. 1. The insulation jacket 24 would be removed to expose the conductors 18, 20 and 22 and the conductors trimmed as shown. Conductor 20 will be somewhat shorter than conductors 18 and 22 and, preferably, will be the black wire. The connector housing 10 will be loaded with terminals 12 and the prepared cable laid in the rear portion with the conductors 18, 22, 20 aligned with the respective access openings 34, 36, 38. The profiling of the conductors, by shortening conductor 20, allows the cable to be properly received in the housing. Should the cable be inadvertently inverted, the length of the white wire 18 will not allow insertion into opening 38 thereby assuring only correct wiring will occur. The cover 14 is then positioned on the housing and forced into latching engagement therewith by shoulders 66, 68 engaging shoulders 56. This application of the cover causes guide members 70, 72, 74 to engage the respective conductors 18, 22, 20 and drive them into the slots 88 of the associated terminals 12. The cover 14 is then secured to the housing by screws 80 passing through bores 60 into bores 76. This also causes bar 78 to be pressed against the cable 16 to provide strain relief therefor.

Figure 3:
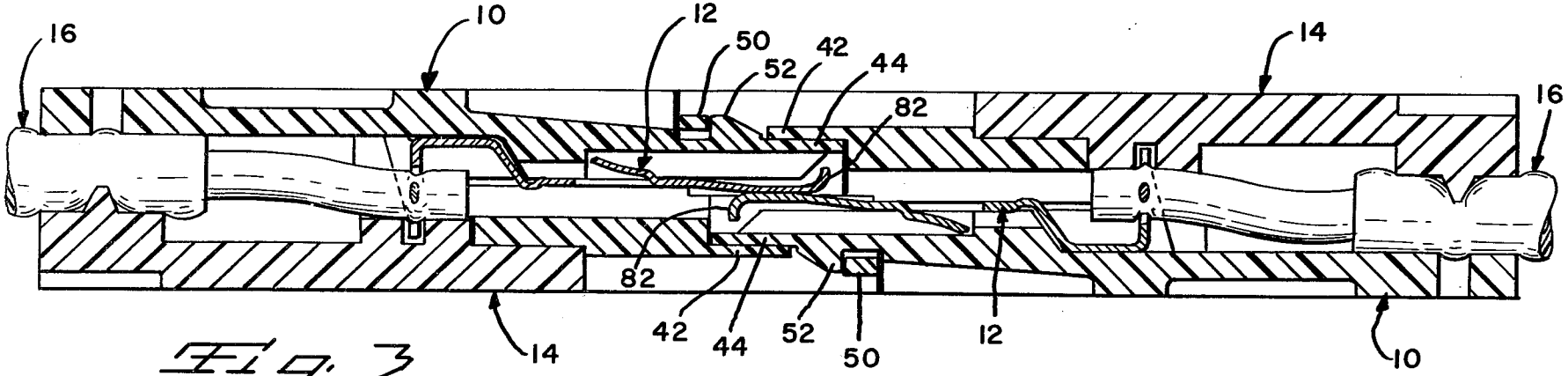
FIG. 3 is a longitudinal section, similar to FIG. 2, through a mated connector according to the present invention.

The connector members are mated in locking fashion as shown in FIG. 3. This Figure shows each of the second wall portions 44 lying inside of the respective first wall portions 42 with the lugs 52 projecting through the respective apertures 48. The blades 82 of the respective terminals 12 are also in a surface to surface engagement. In this condition the connector members are securely held in the mated condition and will withstand even substantial pulling forces applied to the cables 16. The mated connector members can be separated by inserting prying means under the latching bars 50 and levering the outer wall member 42 until lug 52 clears aperture 48.

Figure 4:
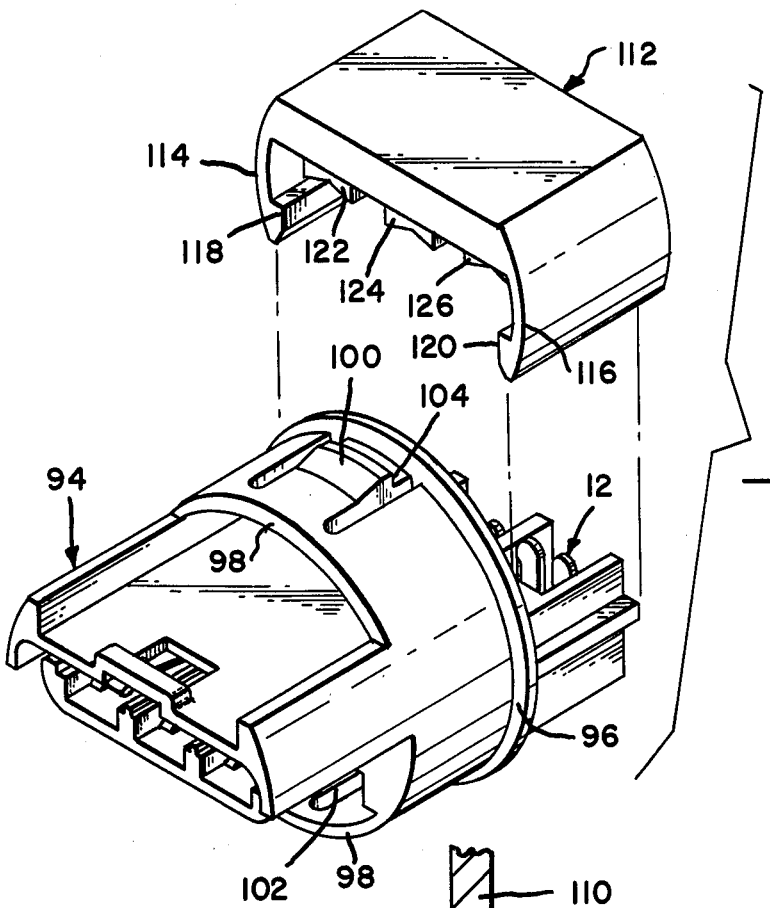
Figure 5:
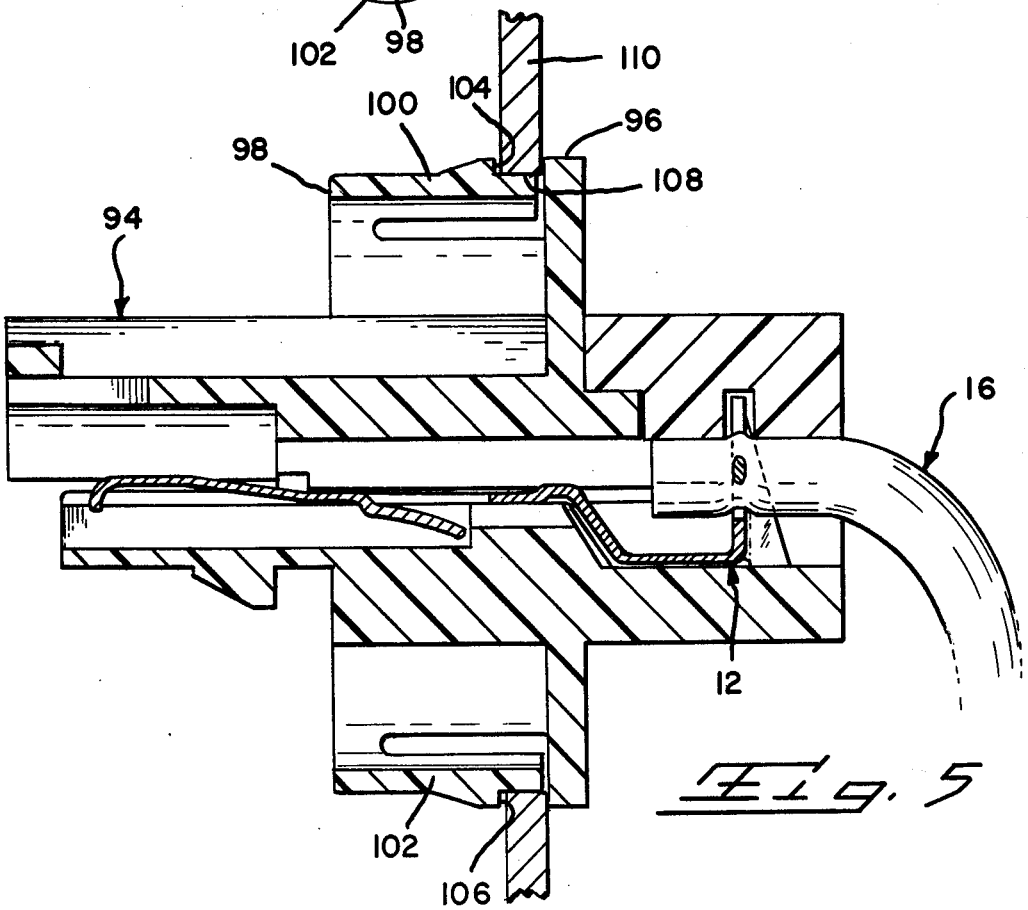
FIG. 5 is a vertical longitudinal section through the connector of FIG. 4 mounted in a panel.
Figure 6:
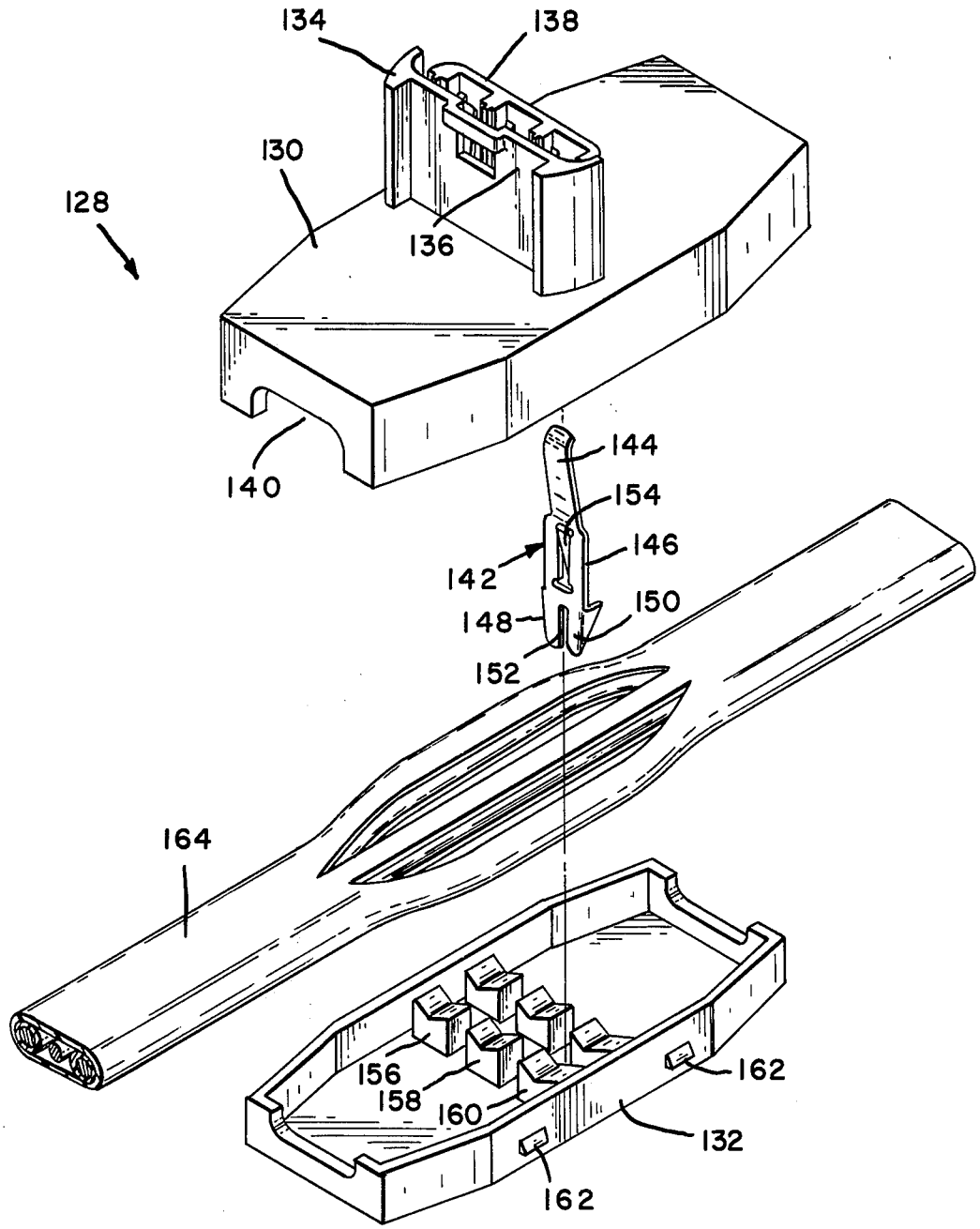
FIG. 6 is an exploded perspective view of a line tap embodiment of the connector according to the present invention.

An alternate embodiment of the subject connector is shown in FIGS. 4 and 5. This embodiment has a mating half identical with that of the above-described preferred embodiment. The rear portion of this embodiment includes means for mounting the connector in a profiled aperture in a panel. The connector housing 94 includes an integral radial flange 96 having an integral substantially cylindrical extension 98 adjacent the periphery thereof coaxial with the housing 94. At least two locking latches 100, 102 are provided on opposite sides of the extension, each with an outwardly directed locking step or shoulder 104, 106, respectively. The cover 112 is a foreshortened version of cover 14 in that the strain relief portion is omitted. The cover includes only legs 114, 116 with shoulders 118, 120 and conductor guides 122, 124, 126. This embodiment is assembled in the same fashion as the above described preferred embodiment.

The connector is mounted in a panel by passing the body 94 through a profiled aperture 108 in a panel 110, such as the sidewall of the power distribution box, until the steps 104, 106 engage with the panel to lock the connector in place. A groove or recess (not shown) can be provided in each latching member, adjacent the step thereof, if it is desired to provide even more positive locking of the connector in a panel. As shown in FIG. 5, the connector would be mounted in a right-to-left direction. However, with extension 98 positioned on the opposite side of flange 96 it would be possible to insert the connector from the opposite direction.

A further alternate embodiment is the line tap 128 shown in FIG. 5. The line tap comprises a front cover 130 and a rear cover 132. The front cover 130 includes, on its outer surface, a mating portion 134 including first and second wall portions 136, 138, respectively. These wall portions are the same as the previously described wall portions but extend normal to the longitudinal axis of the line tap 128. The rear of the front cover 130 includes a longitudinal channel 140 and a plurality of profiled terminal apertures (not shown).

The terminals 142 are similar to the previously described terminals at their mating end with blade 144 extending from a body 146 and an in line insulation displacing slotted beam end portion including a pair of parallel spaced arms 148, 150 defining a slot 152 therebetween. The terminal also includes a mounting lance 154.

The rear cover 132 includes a plurality of integral conductor guides 156, 158, 160 each aligned with a respective terminal aperture in the front cover. A plurality of outwardly directed latching lugs 162 are integral with the back cover and are adapted to mate with latching recesses (not shown) in the front cover. Of course, any well known interior or exterior latching means may be substituted for the one shown to secure the front and back covers together.

In order to mount the subject line tap on an associated cable 164, the cable must first be prepared as shown by slicing through the outer insulation jacket of the cable and separating the conductors into alignment with the contacts. The tap is assembled by laying the prepared cable 164 in channel 140 and squeezing the back cover into place. This squeezing action causes the guide members 156, 158, 160 to drive the respective conductors of cable 164 into the slots 152 of each terminal 142. The arms defining the slot displace the insulation surrounding the conductors to establish good electrical and mechanical contact therebetween.

While it would normally not be considered necessary to include a keying arrangement with a hermaphroditic connector, the present system can utilize keying for the purpose of assuring mating between portions of the circuit which have like current capacities. For example, one circuit designed to carry 15 amps, 115 volts might have a single detent keying system (not shown) while a second connector intended for use on a 20 amp, 220 volt circuit might have two such keying members or keying members placed at different locations across the faces of the hooded portions. Thus correct mating of the connectors would be assured.

It should be noted that the conductor guide means in each of the covers have been shown as spaced pairs of blocks having a V-shaped conductor engaging surface. The shape of the surface tends to correctly center the conductor while the space between the blocks receives therein the slotted beam of the respective terminal.

It should also be noted, particularly from FIG. 4, that the outer periphery of the subject connector has a truncated circular profile. This shape has proved to be advantageous in snaking joined cables and covering punchout holes in junction boxes and the like.

The present invention may be subject to many modifications and changes without departing from the spirit or essential characteristics thereof. Therefore the above described embodiments should be considered as merely illustrative and not restrictive as to the scope of the invention.

What is claimed is:

1. A matable electrical connector assembly for conventional house wiring applications and the like, each said assembly comprising:

a connector housing block having a body of insulating material defining a conductor engaging portion and an oppositely directed mating face, at least two profiled terminal bores in said block extending from said conductor engaging portion to open on said mating face, each said bore having an access slot at the conductor end thereof, one said slot being of lesser length than the remaining slots, first and second channel-shaped walls integral with said block and extending from said mating face in cantilever fashion in parallel spaced relation to define therebetween a female receptacle, said channel shape of said first walls being defined by a flat base and spaced arcuate sidewalls, said first walls having their channel configurations opening inwardly towards each other, said second walls being spaced more inwardly from the peripherial edge of mating face of said block than said first walls forming an outwardly directed step, said second walls having outer dimensions and configuration adapted to mate with the inner surface of said first walls, locking means including an outwardly directed lug on said second walls spaced from the free end thereof and an aperture in said first walls spaced a like distance from the free end thereof;

a plurality of hermaphroditic terminals equal in number to the bores in said housing, each said terminal having a mating blade portion extending in a first direction from a body and means on the opposite end defining an insulation piercing conductor engaging portion, and lance means adapted to fixedly mount said terminals in a respective one of said bores with said mating blade portion projecting from said mating face and enclosed by said first and second walls; and a cover member matable with said conductor receiving portion, said cover member having at least one conductor guiding member depending from an inner surface thereof and aligned to guide and drive a conductor into said insulation displacing means of the associated contact, means to detachably secure said cover member on said conductor receiving portion to grippingly secure a conductor cable therebetween.

2. A matable electrical connector assembly according to claim 1 further comprising means for detachably securing said housing block in a profiled aperture in a panel, said means comprising:

an integral radial flange intermediate the ends of said block, a cylindrical flange extending from adjacent the periphery of said flange coaxial with said housing, at least two spaced apart, resilient cantilever arms integral with the cylindrical flange; and an outwardly directed stop adjacent the free end of each said arm and adapted to grippingly engage in said profiled aperture.

3. A matable electrical connector assembly according to claim 1 further comprising:

keying means including at least one slot on one of said channel-shaped wall members and a like projection on the other of said channel-shaped wall members whereby connectors of different circuits can be identified and properly mated.

4. A matable electrical connector assembly according to claim 1 wherein said housing block has a truncated circular transverse profile.

5. A matable electrical connector assembly according to claim 1 wherein said means to detachably secure said cover member on said conductor receiving portion comprises:

at least two arms integral with and depending from said cover member;

at least two recesses in said housing block adjacent said conductor receiving portion, said recesses adapted to latchingly engage said arms of said cover member.

6. A matable electrical connector assembly according to claim 5 wherein said conductor engaging portion of said connector housing block includes strain relief means comprising:

a channel-shaped conductor receiving portion integral with and extending rearwardly from said housing block;

said cover member having an elongated profile matable with said conductor receiving portion; and said means to detachably secure said cover to the conductor receiving portion further including screw means at the free end of said portion engagable with said cover member to grippingly secure a conductor cable therebetween.

* * * * *